United States Patent [19]

Mills, Jr.

[11] 4,341,731

[45] Jul. 27, 1982

[54] APPARATUS FOR EFFICIENT GENERATION OF LOW-ENERGY POSITRONS

[75] Inventor: Allen P. Mills, Jr., New Providence, N.J.

[73] Assignee: Bell Telephone Laboratories, Incorporated, Murray Hill, N.J.

[21] Appl. No.: 109,776

[22] Filed: Jan. 7, 1980

[51] Int. Cl.[3] ..... G21G 1/06

[52] U.S. Cl. ..... 376/156; 376/913

[58] Field of Search ..... 176/11; 250/346 R, 443, 250/496 R, 526; 376/156, 913

[56] References Cited

PUBLICATIONS

Alpha-, Beta-and Gamma Ray Spectroscopy, vol. 1, pp. 379–402, North Holland Pub. Co., Parker et al.

Nucl. Instr. and Methods, vol. 7 (1960), pp. 22–36, Parker et al.

Canadian Journal of Physics, vol. 50, (1972), pp. 1414–1418, Jaduszliwer.

J. Phys. Bi. Atom. Molec. Phys., vol. 5 (1972), pp. L167–L169, Canter et al.

Phys. Rev. Lett., vol. 41 (1978), pp. 1076–1079, Mills et al.

Appl. Phys. Letters, vol. 35 (9/1/79), pp. 427–429, Mills et al.

Canadian Journal of Physics, vol. 54, pp. 1527–1529 (8/1/76), Pendyala et al.

Tracer Diffusion Data for Metals, Alloys and Simple Oxides, IFI Plenum, N.Y. (1970), pp. 45 and 53, Askill.

Constitution of Binary Alloys, McGraw-Hill, N.Y. (1958), pp. 469–471, Hansen et al.

Solid Surface Physics, Springer Verlag (1979), pp. 116–125, Holzl et al.

*Primary Examiner*—Sal Cangialosi

*Attorney, Agent, or Firm*—Richard D. Laumann; Eugen Pacher

[57] ABSTRACT

A method for efficiently generating thermal positrons from a source of energetic positrons, consisting of a method for increasing the emission efficiency of the positron source, and a method for increasing the efficiency of a positron moderator. In an advantageous case the combined improvements lead to an about ten-fold increase in generated thermal positrons. The method for improving the source efficiency consists in reducing the self-absorption of positrons, typically emitted from radioactive atoms incorporated into a substrate by means of diffusion, by the source. This is accomplished by providing for a backing layer having a relatively small diffusion constant for the radioactive species, and a thin diffusion layer having a relatively large such diffusion constant, with the diffusion layer deposited onto the backing layer. Depositing the required amount of radioactive material onto the diffusion layer and raising the temperature of the sandwich to an appropriate diffusion temperature causes the radioactive material to diffuse into the sandwich, where it will remain concentrated mostly in the diffusion layer, thus being closer to the surface of the source than in typical prior art devices. The method for improving the moderator consists in preparing the moderator from a high-quality single crystal, of high purity, of material having a relatively short stopping distance for energetic positrons, and a relatively long mean diffusion distance for positrons. The active surface of the moderator is to be parallel to a low-index plane of the crystal, selected to have a relatively large negative positron work function. The efficiency of the moderator can be further improved by activating the active surface with about a monolayer of an appropriate chemical species having the property of making more negative the positron work function. An embodiment of method is a $^{58}$Co source consisting of a W backing layer and a 2 μm thick Cu diffusion layer, and a moderator consisting of 99.999 percent pure copper, with (111) active surface, activated by about a $\frac{1}{3}$ monolayer of S.

9 Claims, 3 Drawing Figures

APPARATUS FOR EFFICIENT GENERATION OF LOW-ENERGY POSITRONS

TECHNICAL FIELD

Background of the Invention

1. Field of the Invention

This invention concerns the generation of radiant energy and employs a radiation modifying member, more particularly, it relates to positron sources and moderators for energetic positrons.

2. Description of the Prior Art

The positron, i.e., the electron's antiparticle, was discovered in 1932, and since that time many nuclear reactions have been found that yield positrons. Also, a variety of uses for positrons have been found, ranging from experiments that test fundamental physical theories to the study of defects in solids and the study of solid surfaces. Typically these applications require a well-characterized beam of positrons, and this means generally an essentially monoenergetic beam. Since radioactive sources typically emit positrons over a broad energy range means for narrowing this range are required.

One method for achieving this narrowing involves moderating the energetic positrons to near-thermal energies. By this is meant a slowing down of the positrons, which typically are emitted with energies of many kiloelectron volts (keV), to energies of the order of 1 eV. This slowing down is typically accomplished with the aid of a solid moderator, comprising one or more solid objects upon which energetic positrons impinge. These positrons interact with the solid, thereby giving up energy to it, and eventually a small fraction of the incident positrons is re-emitted from the moderator, thus becoming available as probe radiation.

A great variety of solid moderators have been described in the literature. For a partial listing see, for instance, S. Pendyala, et al, *Canadian Journal of Physics,* Volume 54, pages 1527–1529 (1976). Up until recently the processes involved in moderating high-energy positrons in solids were not well understood and, therefore, moderators were designed essentially on an ad hoc basis. Such an approach naturally did not permit optimization; consequently, prior art moderators had relatively low efficiences. If we define the efficiency $\epsilon$ of a slow positron generating system as the ratio of the slow positron yield to the total yield of positrons from the radioactive source then probably the highest yield achieved in the prior art was $\epsilon \approx 10^{-4}$, as reported for a carbonized gold foil moderator by S. Pendyala and J. W. McGowan, *Journal of Electron Spectroscopy,* to be published.

Radioactive sources often suffer from self-absorption of the emitted positrons, which, of course, results in a reduced useable flux of particles, thus lowering the overall efficiency of a positron generating system. In typical prior art sources the radioactive material is deposited in some convenient manner, for instance by electrodeposition, on one surface of a substrate. To assure the physical integrity of the source, it is then desirable to incorporate the radioactive material into the substrate. This is generally done by means of solid state diffusion, resulting in a typical diffusion profile of the radioactive atoms in the substrate. As is well known, diffusion of component A, present in form of a surface layer, into a substrate having no composition-discontinuities or the like results in a concentration profile of component A that has, as a function of distance from the surface x, a continuous negative slope. By a concentration profile having a "continuous" slope I mean a profile such that, loosely speaking, the left and the right derivatives of c(x) are essentially equal for every point x, where c(x) is the concentration of component A at x. Similarly, by a concentration profile having a "discontinuous" slope I mean a profile having at least one point $x_o$ where the left and right derivatives of c(x) are substantially different.

As a consequence of the distribution that results from this method of preparation of a source an appreciable fraction of the radioactive atoms will be located at significant distances from the substrate surface, and thus the positions emitted from these atoms will have a greatly reduced probability of emission from the source. This process preferentially attenuates the low-energy tail of the emission spectrum, but unfortunately relatively low-energy positrons are the ones that can be most efficiently thermalized.

SUMMARY OF THE INVENTION

I have been able to apply recently acquired understanding of the slow-positron emission process from clean single crystal surfaces in ultra-high vacuum to improve on solid positron moderators. I will also disclose an improved positron source that reduces self-absorption by the source. Together, these improvements, in an advantageous case, result in an about tenfold efficiency increase over the best prior art apparatus.

The apparatus to be disclosed uses an appropriately oriented high-quality single crystal of a material having a relatively short penetration depth for energetic positrons and a relatively long mean diffusion distance for positrons. The crystal has an active surface prepared to be essentially atomically clean before typically covering it with an effective amount, typically approximately a monolayer or so, of atoms of one of those elements that have the property of lowering the positron workfunction of the active surface. Energetic positrons impinging on the crystal penetrate for some distance into it while being slowed down and eventually thermalized. These thermal positrons then undergo normal diffusion, and a certain fraction of them will reach the vicinity of the active surface. Because the positron workfunction of that surface is negative these positrons will be ejected from the moderator into the vacuum, where they are available for appropriate manipulation.

The apparatus can also incorporate a more efficient positron source. This source comprises a backing layer, a diffusion layer, and, during fabrication, a layer of an appropriate radioactive material, arranged in a sandwich geometry. The materail for the backing layer is chosen to have a relatively small diffusion constant for the radioactive material, whereas the diffusion layer is chosen to have a relatively large such diffusion constant, both at some diffusion temperature appropriate to the particular combination of materials. Maintaining such a structure for an appropriate period at the diffusion temperature results in the diffusion of the radioactive material into the diffusion layer, and, to a much smaller degree, into the backing layer. Thus, the greatest part of the radioactive material will remain close to the free surface of the diffusion layer, and self-absorption by the source will be significantly reduced, resulting in increased useable flux of positrons.

The achieved manyfold increase in available flux of thermal positrons makes possible applications of positrons that previously were difficult or impossible, such as, for instance, high-resolution investigation of surface properties and near-surface defects, the study of positron diffraction as a complement to low energy electron diffraction, the study of positron surface states, and of positronium. In particular, the improved efficiency makes practical the use of positrons for high precision measurements of the work function, and of changes thereof, in solids, quantities of significance in many applications, such as, for instance, in catalysis and electrochemistry. And, of course, the thermal positrons generated by the disclosed apparatus, which have typically an energy spread of only some 0.1 eV, can be accelerated again to yield an essentially monoenergetic beam of positrons of any desired energy. The increased flux generated thus clearly is of benefit to all applications of essentially monoenergetic positrons. Furthermore, it will make possible new applications, such as, for instance, the use of radioactive sources of positrons for storage rings. Further refinements of the apparatus, such as increasing the surface to volume ratio of the moderator, or increasing the effective positron diffusion constant of the moderator by means of cooling it, or by providing an internal electric field in the moderator, are possible and may result in even better efficiency, but will not be discussed further.

BRIEF DESCRIPTION OF THE DRAWINGS

FIG, 2 schematically shows a typical concentration profile of radioactive material in an improved positron source.

DETAILED DESCRIPTION

I will now discuss the details of my invention, concentrating on those parts of a low-energy positron generating system that have been improved by me, while foregoing any discussion of those parts of such a system that remain conventional, such as, for instance, support structures, decelerating or accelerating electrodes, guiding magnetic or electric fields, and vacuum systems. However, it may be worthwhile to point out that my invention can be successfully practiced only in a vacuum of such quality that the state of the moderator active surface does essentially not change during the duration of an experiment. This clearly implies the necessity for ultra-high vacuum, with pressures of $10^{-9}$ Torr or less.

Figure 1:
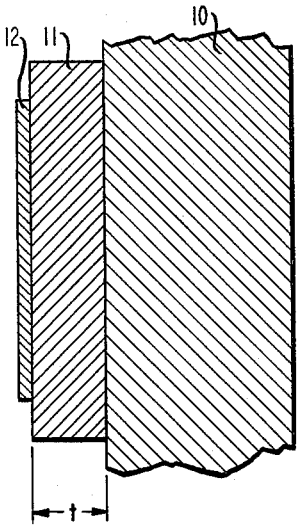
FIG. 1 schematically shows in cross-section an improved positron source prior to diffusion.

As I have pointed out previously, prior art positron sources often suffer from significant self-absorption of emitted positrons, resulting in reduced flux, especially of relatively low-energy positrons. This shortcoming is substantially improved by a source of a design as schematically shown in FIG. 1. A diffusion layer 11, of thickness t, is deposited onto at least part of one surface of backing layer 10. The main function of the backing layer is to give rigidity and mechanical strength to the positron source, thus, its dimensions and shape can be chosen as is required by the specifics of the apparatus. However, rigidity could also be inparted by other means, for instance a fourth and different layer, and in such a case the backing layer could be quite thin, and serve essentially only as a diffusion barrier. The diffusion layer should be as thin as possible, ideally less than the mean stopping distance of the positrons emitted by the radioactive species chosen for the source, probably no more than about 2 μm, but sufficiently thick to allow incorporation of at least a substantial part of the radioactive material of layer 12 into the diffusion layer at the diffusion temperature. Layer 12, i.e., the radioactive material, is deposited onto all or part of the free surface of the diffusion layer. The deposition could, for instance, be carried out by electrodeposition, but other methods can be used as well. In addition to having sufficient solubility for the radioactive species, the material of the diffusion layer should have a relatively large diffusion constant for the radioactive species at an appropriate diffusion temperature. On the other hand, the material of the backing layer is chosen to have a relatively small diffusion constant for the radioactive species at that diffusion temperature. And, of course, the materials must be chosen to result in good adhesion between backing layer and diffusion layer.

Figure 2:
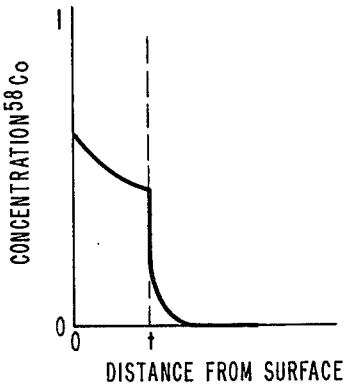

If such a structure is maintained at an appropriate temperature for an appropriate length of time, then the radioactive material will diffuse into the diffusion layer, but only to a much smaller extent into the backing layer, resulting in a distribution of radioactive material as shown schematically in FIG. 2. In other words, the resulting concentration profile has a discontinuous slope at $x=t$. I will refer to that volume of the source that contains the radioactive material as the "active volume." As is evident from the description so far, the active volume has a free surface essentially coinciding with at least part of the free surface of the diffusion layer.

In summary, an appropriate choice of materials results in restricting the active volume substantially to the thin diffusion layer, resulting in substantially decreased absorption of positrons in the source, especially marked for those positrons that are emitted at relatively low energies by the decaying atoms.

An isotope of cobalt ($^{58}Co$) is a useful and often used positron emitter, and I designed and had built a $^{58}Co$ positron source embodying the principles discussed above. The backing layer is a strip of tungsten, approximately 0.13 mm thick and about 1 mm wide. Onto one side of this strip I had electroplated an approximately 2 μm thick layer of copper, and the sandwich then annealed in $H_2$. Following the anneal, a layer of $^{58}Co$ was plated onto the copper diffusion layer, and the assembly then annealed in $H_2$ at about 950° C. for about 45 minutes. At this temperature the diffusion coefficient of cobalt in copper appears to be at least 1000 times larger than that of cobalt in tungsten. This relationship was estimated from the data available for an atomic species chemically very similar to $^{58}Co$, namely $^{59}Fe$. See, for instance, T. Askill, *Tracer Diffusion Data for Metals, Alloys, and Simple Oxides,* IFI Plenum, New York (1970), pp. 45 and 53.

At 950° C. Cu can dissolve about 3 percent by weight of Co, and this is sufficient to permit incorporation into the diffusion layer of substantially all of the $^{58}Co$ required to yield a 0.1 Ci positron source. For a source of greater activity of diffusion layer consisting of a material of greater solubility for Co, such as for instance Ni, may be required. The thermal positron efficiency measured when using the new source was about 4.5 times higher than with a traditional $^{58}Co$ on platinum source, showing that the inventive design is very effective in reducing self-absorption of positrons in the source. Of course, a variety of metals are potentially useful for the construction of such a high-yield source. If diffusion and solubility data are available a mere inspection of these data will permit selection of the appropriate materials. If the data are not available then a minor amount of experimentation may be necessary, but, in general, high-melting-point metals have relatively small diffusion constants at the temperatures of interest, and thus are suitable for the backing layer. Such metals, for instance, are iridium, molybdenum, niobium, osmium, rhenium, tantalum, and tungsten. Similarly, the material to be used as diffusion layer advantageously is chosen to have a moderate melting temperature, substantially lower than that of the backing layer, since this typically will result in the desired relationship between the diffusion constants. For example, copper, silver, gold, platinum and nickel are metals generally useful as diffusion layer material.

I will next discuss the operation and design of the positron moderator. Energetic positrons incident on a solid object such as a single crystal of metal penetrate the surface and will travel on the average for a distance $\lambda$ in the bulk before losing all their excess energy, i.e., before becoming thermalized. The penetration depth or stopping distance $\lambda$ is a function of the incident energy of the particle, and, for our purposes, can be considered to be proportional to this energy. After having become thermalized the positrons will diffuse, i.e., undergo essentially random motion, through the lattice of the solid. For purposes of exposition I have a slab-like moderator in mind, with the thermalized positrons being ejected primarily at one of the plane surfaces of the slab. I will refer to this surface as the "active surface" of the moderator. Of those thermalized positrons that are diffusing towards the active surface a certain fraction will, in fact, reach that surface. That fraction will depend on the diffusion constant of positrons in the host lattice, the mean lifetime of positrons in the host lattice, the stopping distance $\lambda$, and the energy distribution of the positrons that penetrate into the moderator. Since $\lambda$ increases with energy it is clearly advantageous if that energy distribution contains a substantial proportion of relatively low-energy positrons. It is for this reason, among others, that the above-disclosed positron source results in greatly improved efficiency of thermal positron generation.

Since at normal temperatures and in the absence of applied electric fields electrons are generally not emitted from solid surfaces it is clear that a surface potential must prevent the escape of any free electrons from the solid. A potential that is repulsive (i.e., positive) for electrons clearly must be attractive (i.e., negative) for positrons. By convention surface potentials are often discussed in terms of the "workfunction" of the surface for the particles considered. The workfunction is the minimum energy required to move a hypothetical particle at the Fermi level (i.e., either a Fermi surface electron, or a positron in its lowest energy state in the bulk crystal) from the interior of the material to infinity. For the case, discussed above, of a surface potential that is repulsive for electrons the workfunction for positrons typically is negative, depending on the relative magnitudes of the various energy terms whose algebraic sum is the positron workfunction. It may be worth mentioning that the positron workfunction of a surface is not necessarily equal in magnitude and opposite in sign to the electron workfunction of the surface, but that changes in these workfunctions due to, for instance, adsorbates are of equal magnitude and opposite sign.

For a moderator having an active surface with a negative positron workfunction, positrons that arrive at the active surface from the interior of the moderator not only can penetrate the surface and escape into the vacuum, but they actually undergo an acceleration normal to the surface and are emitted into the vacuum with a finite minimum velocity normal to the surface. It is often possible to increase the probability of emission from an active surface by making the positron workfunction of the surface more negative. Such "activation" of the surface can be achieved by depositing an effective amount of an appropriate atomic species on the active surface. By "appropriate atomic species," I mean elements or compounds that interact with the surface such as to make the positron workfunction more negative, of which, for instance, oxygen, sulfur, phosphorus, selenium and carbon monoxide are well known examples. See for instance, J. Holzl et al, *Solid Surface Physics,* Springer Verlag (1979), pp. 116–125. By an "effective amount" I mean an amount sufficient, but not substantially greater than what is necessary, to result in a substantial decrease of the positron workfunction. Such an amount is typically more than about 0.1 monolayers. Typically, the decrease in workfunction with increasing coverage saturates when coverage reaches a few monolayers. Therefore, it is generally not advantageous to deposit more activating material than is required to reach saturation, and an effective amount would typically be no more than approximately 10 monolayers.

The above discussion describes the general case, but in order to optimize slow positron generation it is necessary to pay attention to certain details. In particular, I have found that the nature of the moderator material, its structure, its crystalline orientation, and the perfection of the crystalline lattice are important, in addition to the already alluded-to surface condition. Criteria to use in selecting a moderator material are stopping distance, mean diffusion distance, and positron workfunction. A desirable material has relatively small stopping distance and a relatively large mean diffusion distance for positrons. Although data on this point are scanty, it appears that there is no great variation in the mean diffusion distance in various potential moderator materials. Thus, prime concern should be given to minimizing penetration depth, which consideration points to the use of relatively dense materials. Many metals are potentially useful, but semiconductors, such as Ge or Si may also be useful. Because crystalline defects are generally trapping sites for diffusing positrons, the moderator should be in the form of a highly perfect single crystal. Orientation of the crystal has an effect both on stopping distance and on surface condition. Orientations in which channeling is significant should probably be avoided, and similarly, surface orientations that require the presence of steps on an atomic scale are undesirable. This latter requirement is due to the fact that the atomic-scale disorder at steps, ledges, or the like leads to increased scattering of positrons, and thus reduces brightness. This implies to use of low-index planes, such as (001), (011), or (111). However, in at least some materials there can exist great variability between the positron workfunctions of some low index planes. For instance, I have found that in Cu the positron workfunction of (111) is $-0.40$ eV, and that of (110) is $-0.13$ eV. In order to construct an efficient moderator, it is clearly advantageous to select as active surface the crystal plane having the most negative positron workfunction. The active surface of a moderator should be as clean as possible prior to the possible application of any activating layer. This requires, of course, the availability of ultra-high vacuum as well as some means for detaching adsorbed atoms from the surface, such as by heating, electron bombardment, sputtering, or the like.

The following is an example of an embodiment of these principles. A copper single crystal, grown from 99.999 percent pure starting material, spark-cut into a disc of approximately 4 mm radius and 2 mm height, oriented to have (111) planes parallel to the two plane surfaces of the disc, is to be chemically etched and polished, and then transferred to an ultra-high vacuum chamber (pressure in the $10^{-10}$ Torr range). There at least one of the plane surfaces of the disk is to be cleaned by, for instance, argon ion bombardment, followed by an anneal at about 600° C. As can be determined for instance by Auger spectroscopy, the active surface is contaminated at this point by less than a few percent of, typically, a monolayer of oxygen and carbon. Maintaining a clean copper sample in ultra-high vacuum for a prolonged period at temperatures above about 700° C. results in a partial coating of the surfaces with sulfur, presumably due to diffusion from the bulk. In particular, maintaining a crystal prepared as described above for several hours at approximately 900° C. in a vacuum of approximately $2.10^{-10}$ Torr results in the formation of approximately one-third of a monolayer of sulfur on the active surface. I found that the slow positron yield from a Cu (111) surface activated in this manner is approximately twice as large as it is from an equivalent non-activated, i.e., clean, surface. Other methods for activating surfaces with an effective amount of sulfur of course exist also. For instance, the clean Cu crystal can be exposed briefly to a small partial pressure of hydrogen sulfide gas.

Figure 3:
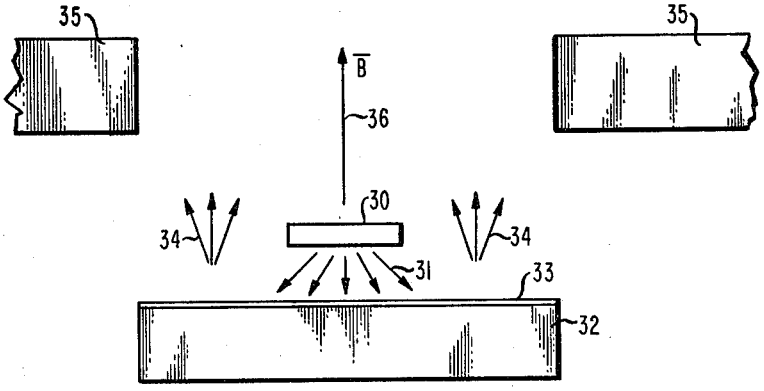
FIG. 3 schematically shows a typical arrangement of a low-energy positron generator, which is the same as can be found in the prior art.

FIG. 3 schematically shows a possible spatial arrangement of the components of a source of low-energy positrons. Positron source 30 is mounted in proximity to a moderator crystal 32. The source emits positrons, as indicated by arrows labeled 31, a significant fraction of which is intercepted by the active surface 33 of the moderator crystal. The active surface is covered by an activating layer, although of course my invention can be practiced with an appropriate clean active surface also. Thermalized positrons, indicated by arrows labeled 34, are ejected from the active surface, and are perhaps guided by a magnetic field 36 or accelerated with the aid of electrodes 35. Whether or not such guiding fields and accelerating fields are present depends strictly on the use to be made of the thermalized positrons, and thus is unrelated to the efficient generation of thermal positrons.

It will be obvious that the geometry shown here is not the only possible one. For instance, since a source located as shown in FIG. 3 will intercept part of the emitted slow positrons, some further improvement in efficiency could perhaps be achieved by a nonaxial placement of the source, or one could use a cupped active surface to intercept more of the energetic positrons from the source. Furthermore, the geometry as shown, i.e., a so-called "backscatter" geometry, is not the only possible one. For instance, a source could be constructed utilizing a "transmission" geometry, which would require a moderator that is only somewhat thicker than the mean stopping distance, together perhaps with energy filter means for separating transmitted thermal positrons from those highly energetic positrons that managed to traverse the moderator without achieving thermalization. Such changes, however, are well within the capability of a person skilled in the art, and therefore will not be elaborated upon.

I claim:

1. Apparatus for generating positrons of approximately thermal energy, comprising (a) a source of positrons comprising radioactive atoms that decay by positron emission, distributed throughout an active volume of a substrate, the active volume having a free surface, the radioactive atoms having a concentration profile, measured in a direction normal to the free surface, with the concentration profile having a continuous negative slope with increasing distance from the free surface;

(b) in an evacuable enclosure, a positron moderator, comprising a solid object having at least one active surface, at least a part of the active surface having a negative positron work function, the moderator being positioned so that a substantial fraction of the positrons emitted from the active volume of the source impinge on the moderator;

CHARACTERIZED IN THAT (c) the substrate of the source comprises a backing layer and a diffusion layer, the diffusion layer covering at least part of a surface of the backing layer, and the slope of the concentration profile of the radioactive atoms, measured in the direction normal to the free surface, has at least one discontinuity, (d) the object consists essentially of a single crystal, oriented to make the active surface of the object substantially parallel to a crystallographic plane having a positron work function more negative than that of clean Al (100), and (e) the enclosure is maintainable at a pressure less than or equal to about $10^{-9}$ Torr.

2. A positron source comprising radioactive atoms that decay by positron emission, distributed throughout an active volume of a substrate, the volume having a free surface, the radioactive atoms having a concentration profile, measured in a direction normal to the free surface, with the concentration profile having a continuous negative slope with increasing distance from the free surface,

CHARACTERIZED IN THAT the substrate of the source comprises a backing layer and a diffusion layer, the diffusion layer covering at least part of a surface of the backing layer, and the slope of the concentration profile of the radioactive atoms, measured in the direction normal to the free surface, has at least one discontinuity.

3. In an evacuable enclosure, a positron moderator comprising a solid object having at least one active surface, at least a part of the active surface having a negative positron work function,

CHARACTERIZED IN THAT (a) the object consists essentially of a single crystal oriented to make the active surface of the object substantially parallel to a crystallographic plane having a positron work function more negative than that of clean Al (100), and (b) the enclosure is maintainable at a pressure less than or equal to about $10^{-9}$ Torr.

4. Apparatus according to claim 1 or 2 wherein the backing layer consists substantially of material selected from the group consisting of iridium, molybdenum, niobium, osmium, rhenium, tantalum, and tungsten.

5. Apparatus according to claim 4 wherein the diffusion layer consists substantially of material chosen from the group consisting of copper, silver, gold, platinum, and nickel.

6. Apparatus according to claim 1 or 2 wherein the backing layer consists substantially of tungsten, the diffusion layer is approximately 2 μm thick and consists substantially of copper, and the radioactive material is $^{58}Co$.

7. Apparatus according to claim 1 or 3 wherein at least part of the active surface of the object is covered by an approximately 0.1 to 10 monolayers thick activating layer consisting substantially of a chemical species adapted to making the positron work function of the active surface more negative than the work function of the uncovered active surface.

8. Apparatus according to claim 7 wherein the activating layer consists substantially of material selected from the group consisting of sulfur, oxygen, phosphorus, selenium and carbon monoxide.

9. Apparatus according to claim 1 or 3 wherein the object consists of copper oriented to have the active surface substantially parallel to a (111) plane, and the activating layer consists substantially of about a $\frac{1}{3}$ monolayer of sulfur.

* * * * *